US006350105B1

(12) United States Patent
Kobayashi et al.

(10) Patent No.: US 6,350,105 B1
(45) Date of Patent: Feb. 26, 2002

(54) FREQUENCY AND CURRENT CONTROL FOR FLUID MACHINERY

(75) Inventors: Makoto Kobayashi; Masakazu Yamamoto; Yoshio Miyake; Kaoru Yagi; Keita Uwai; Yoshiaki Miyazaki; Katsuji Iijima, all of Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/402,617

(22) PCT Filed: Apr. 22, 1998

(86) PCT No.: PCT/JP98/01847

§ 371 Date: Oct. 29, 1999

§ 102(e) Date: Oct. 25, 1999

(87) PCT Pub. No.: WO98/49449

PCT Pub. Date: Nov. 5, 1998

(30) Foreign Application Priority Data

Apr. 25, 1997 (JP) ..... 9-123560

(51) Int. Cl.[7] ..... F04B 49/06
(52) U.S. Cl. ..... 417/44.1; 417/366
(58) Field of Search ..... 417/44.1, 24, 366; 318/779, 723; 415/70

(56) References Cited

U.S. PATENT DOCUMENTS 4,212,590 A * 7/1980 Jonsson ..... 417/24
4,274,803 A * 6/1981 Spengler et al. ..... 415/70
4,633,157 A * 12/1986 Streater ..... 318/723
4,989,414 A * 2/1991 Murayama et al. ..... 62/228.4
4,999,560 A * 3/1991 Morishima et al. ..... 318/779
5,387,855 A * 2/1995 Miyazaki et al. ..... 318/805
5,674,056 A * 10/1997 Yamamoto et al. ..... 417/366
5,841,263 A * 11/1998 Kaneko et al. ..... 318/807
6,050,780 A * 4/2000 Hasegawa et al. ..... 417/44.11

FOREIGN PATENT DOCUMENTS

JP 9-088871 A * 3/1997 ..... 318/723

* cited by examiner

*Primary Examiner*—Cheryl J. Tyler
(74) *Attorney, Agent, or Firm*—Oblon, Spivak, McClelland, Maier & Neustadt, P.C.

(57) ABSTRACT

A fluid machinery for generating a pressure by rotating an impeller with a motor has a frequency converter (F) for supplying electric power to the motor, a detector for detecting a frequency and a current value, and a program for specifying in advance the relationship between the frequency and the current value. A frequency and a current value in an actual operation are compared with the specified program, and the frequency generated by the frequency converter (F) is varied so that an operating point of the fluid machinery approaches the specified program.

6 Claims, 4 Drawing Sheets

FREQUENCY AND CURRENT CONTROL FOR FLUID MACHINERY

TECHNICAL FIELD

The present invention relates to a fluid machinery, and more particularly to a fluid machinery which includes a centrifugal pump arranged to easily provide constant-flow-rate characteristics suitable for a circulation pump, and an axial-flow pump arranged to easily provide constant-pump-head characteristics suitable for a water supply pump.

BACKGROUND ART

Heretofore, centrifugal pumps have been used as cold or hot water circulation pumps in heating or cooling applications. Important factors to be taken into account in this heating or cooling applications are as follows:

① Even if a required flow rate is known, since there is a slight difference between a calculated pipe-induced loss and an actual pipe-induced loss, the fluid flow rate needs to be adjusted by a valve at site. In this case, the fluid flow suffers an energy loss commensurate with a loss caused by the valve.

② When the pipe-induced loss increases due to aging of the pipe, or clogging of the valve caused by foreign matter, the flow rate is reduced. Therefore, it is necessary to adjust the flow rate periodically by the valve or the like.

③ Because no means for measuring the flow rate is generally available at site, it is necessary to know the pressure with a pressure gage or the like and estimate the flow rate based on a pump characteristic curve. However, this process is low in accuracy.

Conventional techniques for solving the above problems are set forth as follows:

① A signal from an electromagnetic flowmeter is processed by a control console, and the opening of a solenoid-operated valve is controlled. Since this process is expensive and accompanied by a loss caused by the valve, its energy-saving effect is small.

② A signal from an electromagnetic flowmeter is sent to a frequency converter for operating the pump at variable speeds. This process has an energy-saving effect, but is expensive.

③ The pump has a rotational speed selecting knob which is used to change Q-H characteristics of the pump and also to meet a required flow rate in combination with a valve. This process is effective to reduce an energy loss due to the resistance imposed by the valve, but is not effective to stabilize the flow rate. If there is an increase in the pipe-induced loss, then, the flow rate needs to be adjusted each time the pipe-induced loss increases.

DISCLOSURE OF INVENTION

In view of the above problems, it is therfore an object of the present invention to provide a fluid machinery such as a centrifugal pump or the like which requires no special auxiliary facilities and supplies a stable flow rate at all times regardless of changes in the resistance imposed by the pipe.

Another object of the present invention is to provide a fluid machinery such as an axial-flow pump which generates a constant pump head even when the flow rate varies, and is suitable for use as a water supply pump.

In order to achieve the above object, according to the present invention, there is provided a fluid machinery for generating a pressure by rotating an impeller with a motor, comprising: a frequency converter for supplying electric power to the motor; a detector for detecting a frequency and a current value; and a program for specifying in advance the relationship between the frequency and the current value; wherein a frequency and a current value in an actual operation are compared with the specified program, and the frequency generated by the frequency converter is varied so that an operating point of the fluid machinery approaches the specified program.

According to an aspect of the present invention, the fluid machinery is such a type that a shaft power increases as a flow rate increases at a constant rotational speed, and the flow rate of the fluid machinery is controlled so as to be substantially constant even when a generated pressure varies.

According to an aspect of the present invention, the fluid machinery is such a type that a shaft power decreases as a flow rate increases at a constant rotational speed, and a generated pressure is controlled so as to be substantially constant even when the flow rate varies.

According to an aspect of the present invention, the frequency (Hz) and the current value (A) are related by a unique function and programmed.

For example, the relationship is represented by $A=KHz^n$ (where K and n represent positive constants). The frequency converter has means for changing values of K and n.

According to the present invention, there is also provided a pump assembly comprising: a centrifugal pump driven by a three-phase induction motor; a frequency converter for supplying electric power to the three-phase induction motor; a detector provided in the frequency converter for detecting a frequency and a current value; and a program for specifying the relationship between the frequency and the current value which is stored by the frequency converter; wherein a frequency and a current value in an actual operation are compared with the specified program, and the frequency generated by the frequency converter is varied so that an operating point of the pump is closer to the specified program, and a flow rate is controlled so as to be substantially constant even when a pump head of the pump varies.

According to an aspect of the present invention, the pump assembly has a function for multiplying time outputted from the frequency converter by the value of the constant flow rate for thereby calculating the flow rate. The frequency converter has an indicator for the flow rate.

BEST MODE FOR CARRYING OUT THE INVENTION

An embodiment of a fluid machinery according to the present invention will be described below.

Figure 1A:
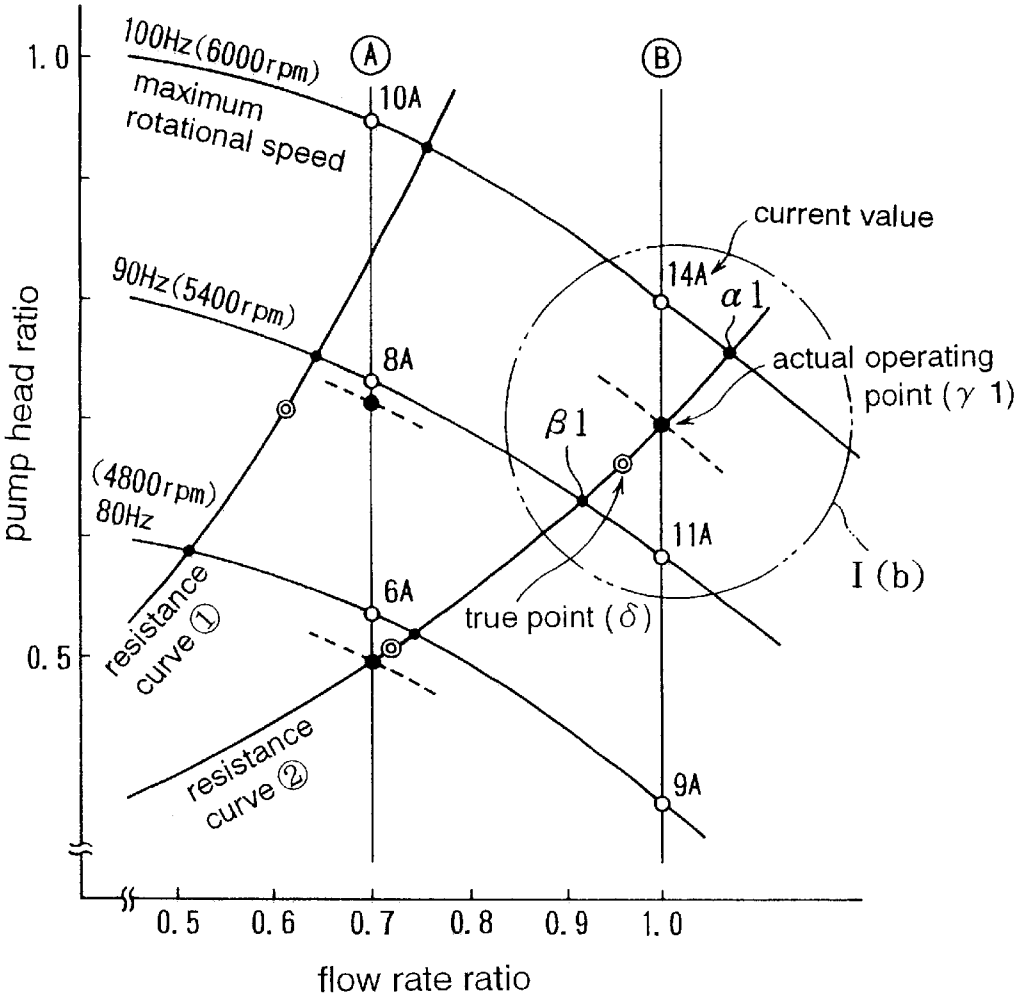
FIGS. 1A and 1B are diagrams illustrative of a basic concept of a fluid machinery according to the present invention.
Figure 1B:
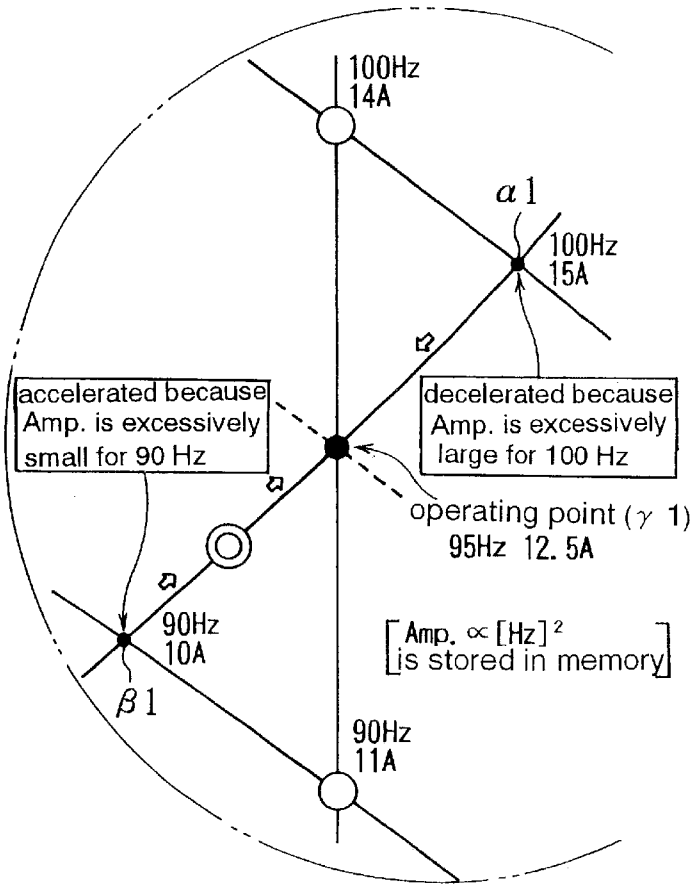

FIGS. 1A and 1B are diagrams illustrative of a basic concept of a fluid machinery according to the present invention. FIG. 1A is a diagram showing the relationship between the flow rate (Q) and pump head (H) of a centrifugal pump which is an example of the fluid machinery, and FIG. 1B is a diagram showing at an enlarged scale an encircled area I(b) in FIG. 1A. In FIG. 1A, the horizontal axis represents the pump head ratio. A motor for actuating the centrifugal pump has an inverter and a knob settable at a plurality of positions (selecting means) for selecting a desired flow rate. The motor comprises a three-phase induction motor, for example.

In FIGS. 1A and 1B, it is assumed that two sets of an inverter frequency (Hz) and a current (A (ampere)) are stored in a memory as follows:

Knob position A $A=0.001\times Hz^2$. . . flow rate ratio 0.7

Knob position B $A=0.0014\times Hz^2$. . . flow rate ratio 1.0

Now it is assumed that the knob position B is selected.

At this time, the pipe exhibits a resistance curve ②in FIG. 1A.

When the pump is actuated, it is operated at a frequency of 100 Hz (6000 rpm) that has been stored beforehand. The operating point is at a point al of intersection (100 Hz—15 A) between the Q-H curve and the resistance curve ②. At this operating point, the current value is larger than the stored current $A=0.0014\times HZ^2$ ($A=0.0014\times 100^2=14$ A), meaning that the current value is excessively large for the frequency of 100 Hz.

The inverter then decelerates the pump to equalize the current to $A=0.0014\ Hz^2$, i.e., operates the pump at a reduced frequency.

It is assumed that the pump is operated at 90 Hz as a result of the deceleration. The operating point is now at a point β1 of intersection (90 Hz—10 A) between the Q-H curve and the resistance curve ②. At this operating point, the current value is smaller than the stored current $A=0.0014\ Hz^2$ ($A=0.0014\times 90^2=11.34$ A), meaning that the current value is excessively small for the frequency of 90 Hz.

The inverter then accelerates the pump to equalize the current to $A=0.0014\ Hz^2$, i.e., operates the pump at an increased frequency.

As a consequence, the pump is operated at a point γ1 where $A=0.0014\times 95^2\approx 12.5$ A (95 Hz—12.5 A).

Therefore, the pump is operated at a flow rate of the selected knob position B. According to this process, the pump is operated at a constant flow rate with a minimum amount of consumed electric power required, regardless of the magnitude and variations of the resistance imposed by the pipe. The process is thus optimum for a circulation pump.

A true point δ, representing a flow rate and a pump head that are really necessary, in FIG. 1A is an operating point where a most suitable quantity of heat is supplied when the pump is used to circulate hot water. This point may possibly deviate slightly from a calculated operating quantity of heat because a margin is introduced for calculations.

In order to solve the above problem, more types (e.g., about 8 types, rather than the two types of A, B shown in FIG. 1A) that can be selected by the flow rate selecting knob for the inverter may be employed.

The foregoing description is directed to the example of a centrifugal pump where the shaft power (consumed electric power and current value) increases as the flow rate increases at a constant rotational speed (constant frequency (Hz)).

Figure 2:
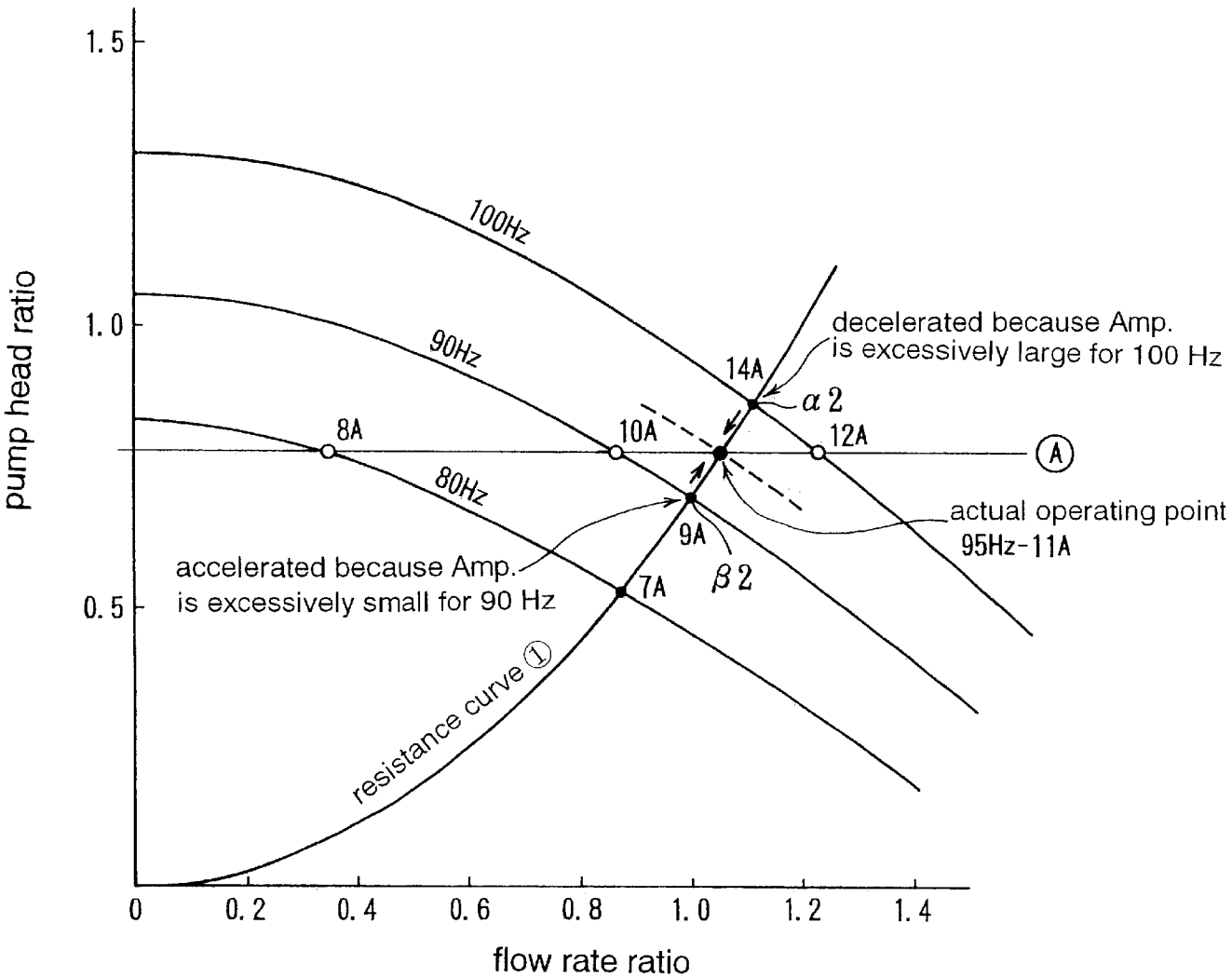
FIG. 2 is a diagram illustrative of a basic concept of a fluid machinery according to the present invention.

FIG. 2 is a diagram illustrative of a process of controlling, under a constant pressure, an axial-flow pump where the shaft power decreases as the flow rate increases at a constant rotational speed (constant frequency (Hz)). In FIG. 2, the horizontal axis represents the flow rate ratio, and the vertical axis represents the pump head ratio.

In FIG. 2, it is assumed that one set of an inverter frequency (Hz) and current (A (ampere) in an inverter is stored in a memory as follows:

$A=0.0012\times HZ^2$. . . flow rate ratio 0.75

The pipe has a resistance curve ① in FIG. 2.

When the pump is actuated, it is operated at a frequency of 100 Hz (6000 rpm) that has been stored beforehand. The operating point is at a point α2 of intersection (100 Hz—14 A) between the Q-H curve and the resistance curve ①. At this operating point, the current value is larger than the stored current $A=0.0012\times Hz^2$ ($A=0.0012\times 100^2=12$ A), meaning that the current value is excessively large for the frequency of 100 Hz.

The inverter then decelerates the pump to equalize the current to $A=0.0012\ Hz^2$, i.e., operates the pump at a reduced frequency.

It is assumed that the pump is operated at 90 Hz as a result of the deceleration. The operating point is now at a point β2 of intersection (90 Hz—9 A) between the Q-H curve and the resistance curve ①. At this operating point, the current value is lower than the stored current $A=0.0012\ Hz^2$ ($A=0.0012\times 90^2=9.72$ A), meaning that the current value is excessively small for the frequency of 90 Hz.

The inverter then accelerates the pump to equalize the current to $A=0.0012\ Hz^2$, i.e., operates the pump at an increased frequency.

As a consequence, the pump is operated at a point where $A=0.0012\times 95^2\approx 11$ A (95 Hz—11 A), i.e., under a selected pressure. According to this process, the pump is operated under a constant pressure (pump head) with a minimum amount of consumed electric power required, regardless of the magnitude and variations of the resistance imposed by the pipe. The process is thus optimum for a water supply pump.

According to the present invention, as shown in FIGS. 1A, 1B, and 2, since the pump alone is capable of maintaining a flow rate or a pressure at a constant level without using an electromagnetic flowmeter or a pressure gage (or a pressure sensor), the user is not required to have special auxiliary facilities and to perform any operation such as an operation for adjusting any valves.

Figure 3:
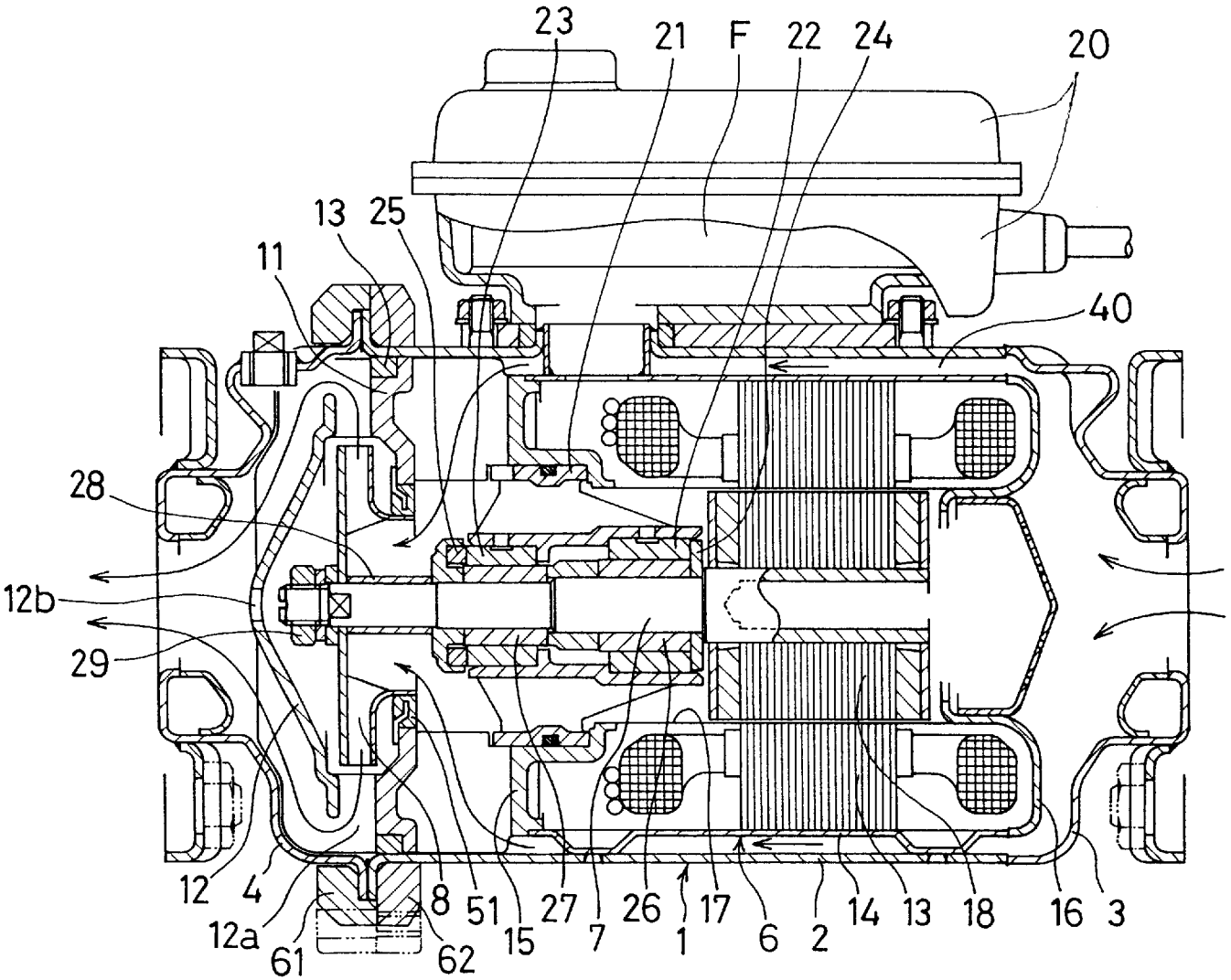
FIG. 3 is a cross-sectional view of a pump assembly suitable for embodying the present invention.

FIG. 3 shows a pump assembly suitable for embodying the present invention. The pump assembly comprises a full-circumferential-flow-type canned motor pump in which a fluid being handled flows around a motor.

The full-circumferential-flow-type canned motor pump according to the illustrated embodiment comprises a pump casing 1, a canned motor 6 housed in the pump casing 1, and an impeller 8 fixed to an end of a main shaft 7 of the canned motor 6. The pump casing 1 comprises an outer pump casing barrel 2 and a suction casing 3 and a discharge casing 4 which are connected respectively to opposite ends of the outer pump casing barrel 2. The suction casing 3 is joined to the outer pump casing barrel 2 by welding, and the discharge casing 4 is joined to the outer pump casing barrel 2 by flanges 61, 62. Each of the outer pump casing barrel 2, the suction casing 3, and the discharge casing 4 is made of sheet metal such as stainless steel.

The canned motor 6 comprises a stator 13, an outer motor frame barrel 14 disposed around the stator 13, a pair of side motor frame plates 15, 16 welded to opposite open ends of the outer motor frame barrel 14, and a can 17 fitted in the stator 13 and welded to the side motor frame plates 15, 16. A rotor 18 rotatably disposed in the stator 13 is shrink-fitted over the main shaft 7. An annular space (flow passage) 40 is defined between the outer motor frame barrel 14 and the outer pump casing barrel 2. An inverter (frequency converter) F is fixedly mounted on an outer surface of the outer pump casing barrel 2 which confines the fluid to be pumped around the motor. The inverter F is housed in a case 20 which accommodates a flow rate indicator and a flow rate selecting knob.

A guide member 11 for guiding the fluid radially inwardly is held by the side motor frame plate 15 of the canned motor 6. The impeller 8 is housed in an inner casing 12 that is fixed to the guide member 11. A seal member 13 is disposed around the guide member 11.

A liner ring 51 is mounted on an inner end of the guide member 11 and held in sliding contact with a front face (inlet mouth) of the impeller 8. The inner casing 12 is substantially dome-shaped, and covers an end of the main shaft 7 of the canned motor pump 6. The inner casing 12 has a guide device 12*a* comprising guide vanes or a volute for guiding the fluid discharged from the impeller 8. The inner casing 12 also has an air vent hole 12*b* defined in a distal end thereof.

Bearings that are used comprise plain bearings made of silicon carbide, and all the bearings are disposed in a space defined between the motor rotor 18 and the impeller 8. The bearings are lubricated by liquid handled by the pump.

A bearing bracket 21 is made of cast stainless steel. Stationary radial bearings 22, 23 are shrink-fitted in axially opposite ends of the bearing bracket 21, and are prevented from rotating by a synthetic resin injected from their outer circumferential surfaces. The stationary radial bearings 22, 23 have axial ends held in sliding contact with respective rotatable thrust bearings 24, 25. The rotatable thrust bearings 24, 25 and rotatable radial bearings 26, 27 are fixedly mounted on the main shaft 7 by a impeller locking nut 29 with the impeller 8 and a distance piece 23 interposed therebetween.

Figure 4:
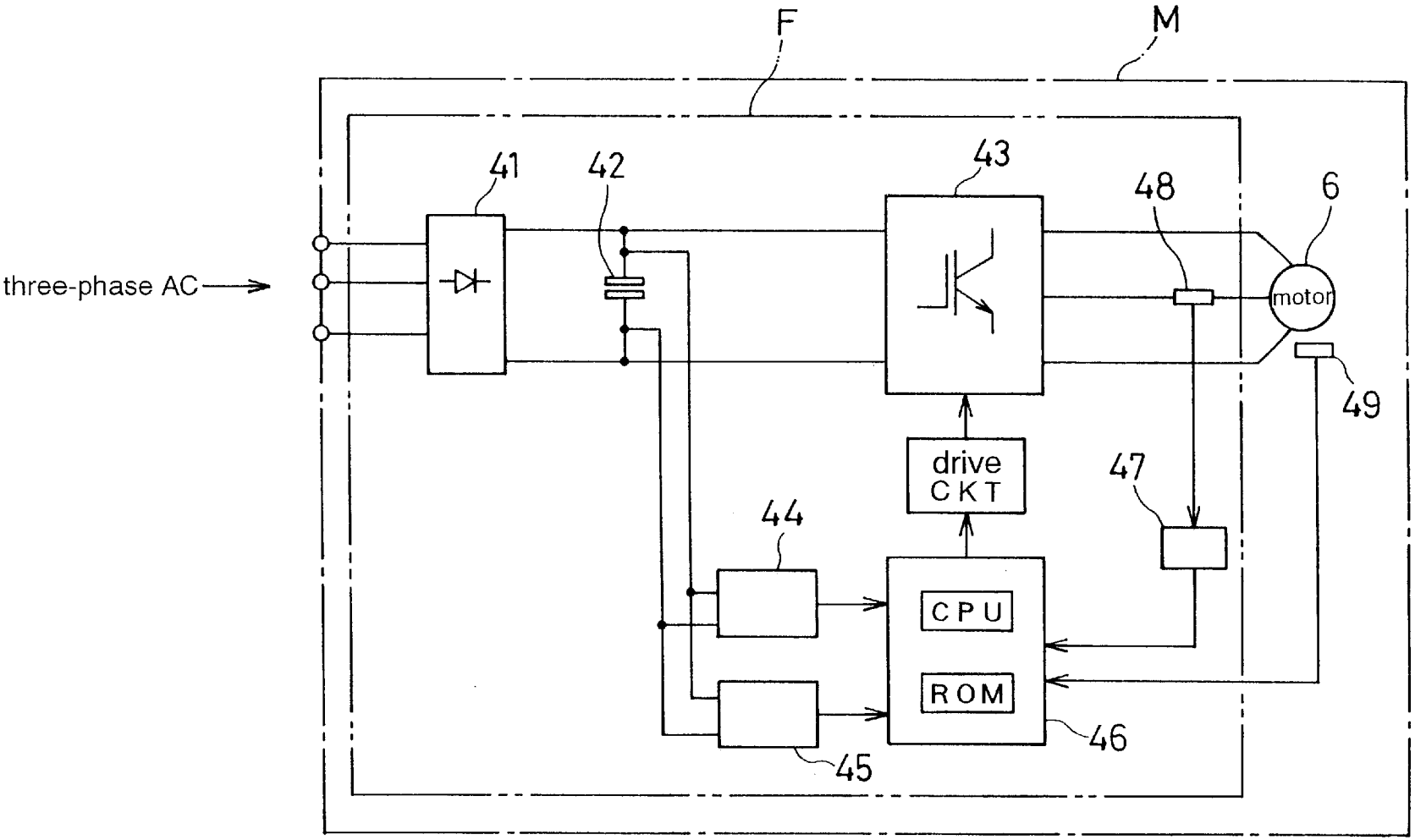
FIG. 4 is a circuit diagram of a frequency converter in the present invention.

Operation of the full-circumferential-flow-type canned motor pump shown in FIG. 3 will briefly be described below. The fluid drawn from the suction casing 3 flows into the annular flow passage 40 defined between the outer motor frame barrel 14 and the outer pump casing barrel 2, passes through the annular flow passage 40, and is guided into the impeller 8 by the guide member 11. The fluid discharged from the impeller 8 flows through the guide device 12*a*, and is discharged from the discharge casing An embodiment of the frequency converter in the present invention will be described below with reference to FIG. 4. In FIG. 4, the fluid machinery such as a pump is denoted by M, and the frequency converter is denoted by F. If a three-phase AC electric energy is supplied to the frequency converter F, then the frequency converter F includes a converter section comprising a rectifying circuit 41 for converting an alternating current into a direct current and a smoothing capacitor 42 for smoothing a rectified voltage, and a three-phase inverter 43 for converting the direct current into an alternating current. To the converter section, there are connected an auxiliary power supply 44 and a voltage detector 45 which detects a DC voltage of the converter section. The frequency converter F also has a controller 46 which stores the relationship between generating frequencies and current values. The controller 46 outputs a PWM signal to drive the three-phase inverter 43.

A current detecting sensor 48 is connected to an output terminal of the three-phase inverter 43. A current detected by the current detecting sensor 48 is converted by a current detector 47 into a signal which is supplied to the controller 46. The three-phase inverter 43 has output terminals connected to the motor 6, which is associated with a temperature sensor 49.

The controller 46 comprises a ROM which stores a function for specifying a generating frequency and a current, a CPU for comparing a signal from the current detector 47 with settings stored in the ROM, performing arithmetic operations, and outputting a PWM signal, and a control IC.

The frequency converter F has the controller 46, and can store time which the frequency converter has outputted. If the pump is operated according to the above constant flow-rate control process, then the frequency converter F is capable of detecting the flow rate of the fluid delivered by the pump from moment to moment. The frequency converter F also has a calculating function. Thus, the frequency converter F can indicate an integrated flow rate, in addition to a flow rate from moment to moment. The pump assembly can therefore be used as a flowmeter.

Furthermore, using a memory function of the frequency converter F, the pump assembly can be automatically operated to perform a task of delivering a certain amount (e.g., 1 $m^3$) of water for an every certain period of time (e.g., 24 hours) for a certain number of successive days (e.g., 5 days), stop performing the task for a certain number of successive days (e.g., 2 days), and perform the task for a certain number of successive days (e.g., 5 days). This process is suitable for limiting the amount of water supper per day for water saving purposes, and has an advantage that it can automatically supply water without the need for any special ancillary facilities.

As described above, the present invention provides a fluid machinery such as a centrifugal pump which needs no special ancillary facilities, but can supply a fluid at a stable rate at all times, regardless of changes in the resistance imposed by the pipe.

According the present invention, there is also provided a fluid machinery such as an axial-flow pump which is capable of generating a constant pump head regardless of changes in the flow rate.

INDUSTRIAL APPLICABILITY

The present invention is preferably applicable to a fluid pump including a centrifugal pump which can easily provide constant-flow-rate characteristics suitable for a circulation pump, and an axial-flow pump which can easily provide constant-pump-head characteristics suitable for a water supply pump.

What is claimed is:

1. A fluid machinery for generating a pressure by rotating an impeller with a motor, comprising:

a frequency converter arranged for supplying electric power to the motor;

a detector for determining a current value; and a controller having a memory storing a program for specifying in advance a relationship between the frequency and the current value;

wherein when the fluid machinery is operated at a certain frequency, the controller is adapted to compare a current value in an actual operation and a current value which is specified on the basis of the certain frequency by the specified program; and wherein the controller is further adapted to decrease the frequency generated by the frequency converter when the current value in the actual operation is larger than the current value specified by the specified program, and to increase the frequency generated by the frequency converter when the current value in the actual operation is smaller than the current value specified by the specified program, whereby one of a flow rate and a generated pressure of the fluid machinery is controlled so as to be substantially constant.

2. A fluid machinery according to claim 1, wherein said fluid machinery is such a type that a shaft power increases as a flow rate increases at a constant rotational speed, and the flow rate of said fluid machinery is controlled so as to be substantially constant even when a generated pressure varies.

3. A fluid machinery according to claim 1, wherein said fluid machinery is such a type that a shaft power decreases as a flow rate increases at a constant rotational speed, and a generate d pressure is controlled so as to be substantially constant even when the flow rate varies.

4. A fluid machinery according to claim 1, wherein the frequency (Hz) and the current value (A) are related by a unique function and programmed.

5. A fluid machinery according to claim 4, wherein the stored relationship between said frequency (Hz) and said current value (A) is expressed by $A=KHz^n$ (where K and n represent positive constants).

6. A fluid machinery according to claim 5, wherein said frequency converter has means for changing values of K and n.

* * * * *

UNITED STATES PATENT AND TRADEMARK OFFICE

CERTIFICATE OF CORRECTION

PATENT NO. : 6,350,105 B1
DATED : February 26, 2002
INVENTOR(S) : Kobayashi et al.

It is certified that error appears in the above-identified patent and that said Letters Patent is hereby corrected as shown below:

Title page,
Item [45], the Date of Patent should read:
[45] **Date of Patent: *Feb. 26, 2002**

The Notice information should read:
[*] Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

Item [86], the PCT Filing Date should read:
[86] PCT No.: PCT/JP98/01847
§ 371 Date: Oct. 25, 1999
§ 102(e) Date: Oct. 25, 1999

Signed and Sealed this

First Day of October, 2002

*Attest:*

*Attesting Officer*

JAMES E. ROGAN
*Director of the United States Patent and Trademark Office*